US005377297A

United States Patent [19]

Nuutinen

[11] Patent Number: 5,377,297

[45] Date of Patent: Dec. 27, 1994

[54] METHOD OF MODIFYING MASONRY FURNACE BY INSERTING ELECTRIC HEATING ELEMENTS THROUGH FURNACE TOP COVER

[75] Inventor: Pekka Nuutinen, Kontiolahti, Finland

[73] Assignee: Suomen Vuolukivi Oy, Juuka, Finland

[21] Appl. No.: 78,213

[22] PCT Filed: Nov. 29, 1991

[86] PCT No.: PCT/FI91/00363

§ 371 Date: Jun. 17, 1993

§ 102(e) Date: Jun. 17, 1993

[87] PCT Pub. No.: WO92/12386

PCT Pub. Date: Jul. 23, 1992

[30] Foreign Application Priority Data

Dec. 31, 1990 [FI] Finland ..... 906467

[51] Int. Cl.[5] ..... F24C 1/02; F24C 7/06; F24H 9/18; H05B 3/00

[52] U.S. Cl. ..... 392/307; 219/523; 219/536; 392/343; 392/344; 392/349

[58] Field of Search ..... 392/307-310, 392/344, 346, 347, 349, 360, 343; 219/523, 536

[56] References Cited

U.S. PATENT DOCUMENTS

| | | | |
|---|---|---|---|
| 1,495,685 | 5/1924 | Graf | 392/310 |
| 1,545,079 | 7/1925 | Barlow | 392/307 |
| 4,253,444 | 3/1981 | Johnson | 392/350 |
| 4,263,470 | 4/1981 | Sjöberg . | |

FOREIGN PATENT DOCUMENTS

| | | | |
|---|---|---|---|
| 1170134 | 7/1984 | Canada | 392/307 |
| 62922 | 11/1982 | Finland . | |
| 882580 | 12/1989 | Finland . | |
| 2503847 | 10/1982 | France | 392/307 |
| 90/05270 | 5/1990 | WIPO . | |

*Primary Examiner*—Anthony Bartis
*Attorney, Agent, or Firm*—Watson, Cole, Grindle & Watson

[57] ABSTRACT

A method of combining electric heating with a wood-heated masonry furnace is provided. The masonry furnace has an outer jacket (1) and at least one fire chest (5, 6) arranged therewithin for burning the wood. Cheek conduits (8) between the outer surface of the fire chest and the inner surface of the outer jacket, are provided. The conduits are connected to the fire chest (5, 6) at one end and to a flue (9) at the opposite end. At least one electric resistor element (13) is installed inside the furnace. In order that electrical heating could be easily combined with any existing masonry furnace, holes (14) are drilled in the fire cover (10) of the furnace and the at least one resistor element (13) is arranged to hang from the fire cover (10) in the air space (8, 16) inside the furnace.

4 Claims, 1 Drawing Sheet

METHOD OF MODIFYING MASONRY FURNACE BY INSERTING ELECTRIC HEATING ELEMENTS THROUGH FURNACE TOP COVER

The object of the invention is a method of combining electrical heating with a wood-heated masonry furnace, particularly with a soapstone stove, which comprises an outer jacket and at least one fire chest arranged therewithin for burning the wood, and cheek conduits between the outer surface of the fire chest and the inner surface of the outer jacket, the conduits being connected to the fire chest at one end and to a flue at the opposite end; according to which method at least one electric resistor element is installed inside the furnace.

It is previously known to combine electrical heating with a wood-heated furnace. For example, Finnish Patent 62,922 discloses installation of resistors into smoke canals of a factory-made stove through the bottom of the stove. However, such installation is suited only for factory-made furnaces with a bottom that is not in contact with the ground. Thus, this kind of installation is impossible e.g. in connection with a masonry furnace.

On the other hand, Finnish Patent Application 882,580 discloses walling of resistor elements into the stone wall of the furnace between the surface and double rocks (in other words, to a place that is not necessarily covered with a fire cover). Since installation of resistor elements in this case requires a pre-made groove on the inner surface of the surface rock or the outer surface of the double rock, this kind of installation cannot be provided in an already installed masonry furnace, either.

The object of the present invention is to provide a method by which any existing wood-heated masonry furnace can be easily provided with electrical heating afterwards. According to the invention this is effected by drilling holes in the fire cover of the furnace and by arranging said at least one resistor element to hang from the fire cover in the air space inside the furnace. The air space in this connection means an empty space inherent inside the furnace in which the resistor is surrounded by air. In practice the air space is usually a cheek conduit of the furnace but it can also be an insulating space inside the furnace with empty space for resistor elements.

On account of the solution according to the invention the resistors can also be cleaned or changed easily. Also, in comparison with e.g. the solution presented in Finnish Patent Application 882,580, cheaper resistor elements can be used in the method according to the invention since the resistor elements are in an open space in which the temperature cannot rise as high as in the "closed" space between the surface and double rocks.

Figure 1:
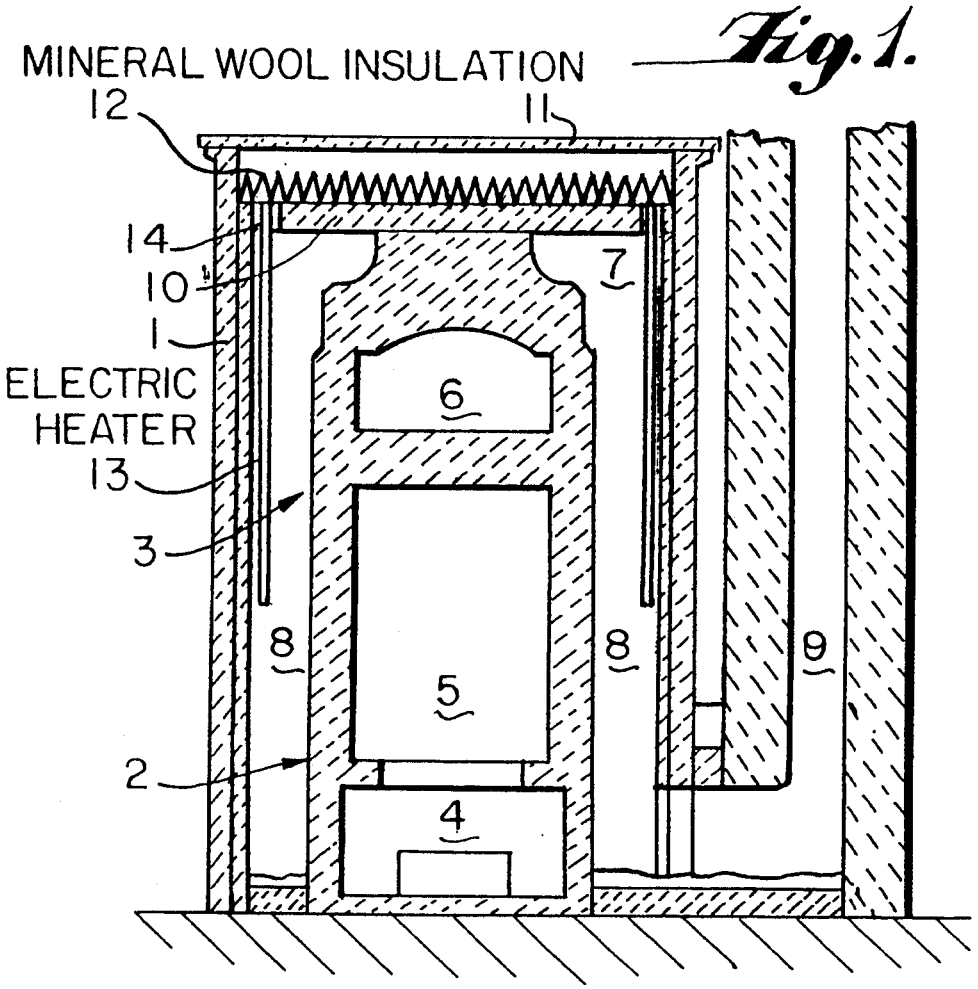
Figure 2:
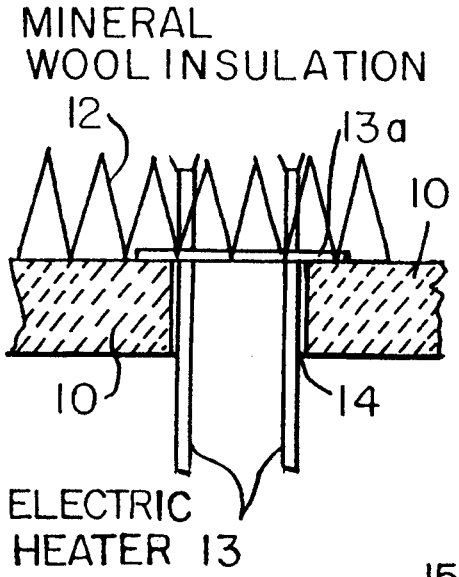
Figure 3:
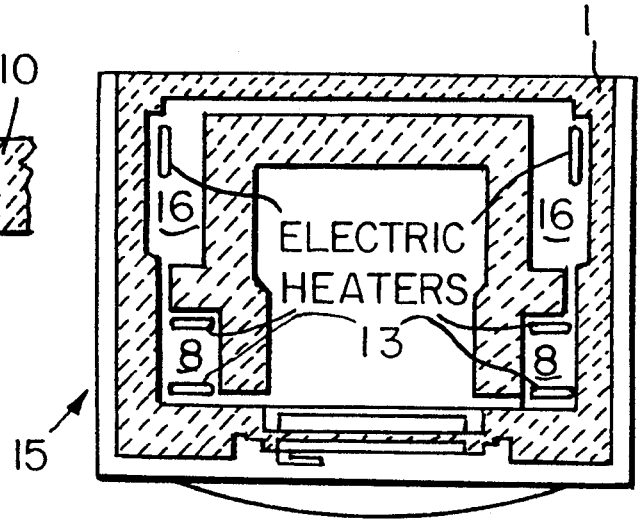

In the following the invention will be described in greater detail with reference to the examples according to the attached drawing, in which FIG. 1 is a transverse cross-sectional view of a masonry combination of a stove and a baking oven, FIG. 2 shows in greater detail installation of resistor elements in the furnace of FIG. 1, and FIG. 3 shows installation of resistor elements in another kind of masonry furnace.

FIG. 1 shows a combination of a baking oven and a stove comprising an outer jacket 1 made of stone material, such as soapstone, comprising a stove 2 and a baking oven 3 thereabove. An ash chest 4 is provided below the stove 2 in the known manner. A fire chest 5 of the stove and a fire chest 6 of the baking oven are combined by conduits (not shown) at the rear portion of the furnace to a secondary combustion chamber 7 in order to conduct combustion and flue gases generated in the fire chests to the secondary combustion chamber. Cheek conduits 8 extend downward from the secondary combustion chamber 7 on both sides on the fire chests 5 and 6, leading to the flue 9 of the combination of a baking oven and a stove. The secondary combustion chamber and the upper portion of the cheek conduits are closed with a fire cover 10, i.e. the cover that covers the conduits of the furnace in which the flue gases move. Above the fire cover 10 there is an upper cover 11 of the stove, and between the upper cover and the fire cover there is mineral wool insulating material 12. According to the invention electric resistor elements 13 are installed in the furnace such that they hang from the fire cover 10 and extend downward to the air spaces formed by the cheek conduits 8.

FIG. 2 shows in greater detail installation of resistor elements in the furnace of FIG. 1. After removing the upper cover 11 (if the furnace concerned has an upper cover), holes 14 are drilled in the fire cover 10 and the resistor elements 13 are introduced into the cheek conduits 8 and attached at their flange part **13*a* to the fire cover 10** with fixing screws (not shown). The resistor elements should preferably be positioned such that they are close to the walls of the cheek conduits, whereby they do not prevent sweeping.

The resistor element 13 can be installed not only in the cheek conduits but also in any other free space inside the furnace where it can be surrounded by air. FIG. 3 shows a cross-sectional top view of places in a baking oven 15 where the resistor elements 13 are installed. Resistor elements 13 have not been installed only in the cheek conduits 8 but also in insulating spaces 16 in the rear corners of the stove as shown in FIG. 2, the insulating spaces being normally filled with mineral wool. In this case the insulating spaces are filled with hard fire wool (not shown) but in such a way that there is an empty air space for resistor elements between the wool and the inner surface of the outer jacket of the stove.

Although the invention has been described above with reference to the example according to the drawing, it is to be understood that the invention is not restricted thereto but that it can be modified in many ways within the limits of the inventive concept set forth in the enclosed claims. For example, the position of the resistor elements in the furnace depends on the type of the furnace in the manner described above.

I claim:

1. Method of combining electrical heating with a wood-heated masonry furnace which comprises an outer jacket having an inner surface, and at least one fire chest arranged therewithin for burning wood and having an outer surface, a fire cover to cover the top of the furnace, and cheek conduits between the outer surface of the fire chest and the inner surface of the outer jacket, the conduits being connected to the fire chest at one end and to a flue at the opposite end; said method comprising the steps of installing at least electric resistor element inside the furnace by drilling at least one hole in the fire cover of the furnace, inserting said at least one resistor element through said at least one hole into an airspace inside the furnace, and arranging said at least one resistor element to hang from the fire cover in said air space, wherein said airspace is defined between the inner surface of said outer jacket and the outer surface of said fire chest.

2. Method according to claim 1, wherein a plurality of resistor elements is installed inside the furnace.

3. Method according to claim 2, wherein the resistor elements are arranged to hang in the cheek conduits of the furnace.

4. Method according to claim 2, wherein the resistor elements are arranged to hang in insulating spaces defined by empty air spaces provided inside the furnace for each resistor element.

* * * * *